United States Patent [19]

Pao

[11] Patent Number: 4,736,594

[45] Date of Patent: Apr. 12, 1988

[54] METHOD AND APPARATUS FOR CONTROLLING REFRIGERATION SYSTEMS

[76] Inventor: Peter Y. M. Pao, 310 W. Rosewood, San Antonio, Tex. 78212

[21] Appl. No.: 893,621

[22] Filed: Aug. 6, 1986

[51] Int. Cl.[4] ..... F25D 21/06

[52] U.S. Cl. ..... 62/155; 62/186; 62/278

[58] Field of Search ..... 62/155, 151, 158, 157, 62/231, 234, 186, 188, 182, 140, 180, 205, 206, 196.4, 278

[56] References Cited

U.S. PATENT DOCUMENTS

| | | | |
|---|---|---|---|
| 2,430,960 | 11/1947 | Soling | 62/278 |
| 2,492,970 | 1/1950 | Carry | 62/182 X |
| 3,377,817 | 4/1968 | Petranek | 62/140 |
| 4,136,730 | 1/1979 | Kinsey | 62/231 X |
| 4,299,095 | 11/1981 | Cassarino | 62/155 |
| 4,356,703 | 11/1982 | Vogel | 62/234 |

*Primary Examiner*—Harry Tanner

*Attorney, Agent, or Firm*—Gary W. Hamilton

[57] ABSTRACT

A method and apparatus for providing optimum control of a refrigeration system during both its cooling cycle and its defrost cycle. During the cooling cycle, the control system maintains operation of a fan for a predetermined period of time sufficient to fully evaporate the liquid refrigerant in the refrigeration system's evaporator coil. The control system initiates the defrost cycle only when the actual system parameters indicate the need to defrost. In the defrost cycle, the flow of hot gas and refrigerant is coordinated in a manner to minimize the amount of energy expended and to reduce thermal shock to the system, thereby eliminating unnecessary wear on the system components.

4 Claims, 2 Drawing Sheets

METHOD AND APPARATUS FOR CONTROLLING REFRIGERATION SYSTEMS

FIELD OF THE INVENTION

The present invention relates generally to the field of industrial refrigeration control systems. Specifically, the present invention provides a method and apparatus for providing optimum control of a refrigeration system during both its cooling cycle and its defrost cycle. The method and apparatus shown herein results in increased efficiency and extended operational lifetime of the refrigeration system components.

BACKGROUND

In the field of industrial refrigeration systems, one of the major concerns is that of maintaining the optimum temperature in a cold storage room. Heat is removed from the storage compartment by an evaporator unit consisting of a fin coil heat exchanger and a fan motor for recirculating the air in the compartment. In most current cold storage systems, the evaporator fan motor operates continuously and the capacity controller on the system compressor is used to maintain the suction temperature, which in turn controls the evaporator temperature.

One of the major problems in virtually all refrigeration systems is the buildup of frost on the evaporator coils. Frost buildup is directly related to two factors: (1) moisture in the air which infiltrates into the system as a result of traffic in and out of the storage area; and (2) moisture deposits which are the result of evaporation from products stored in the system. As the frost builds up on the evaporator coil, it insulates the coil's surface thus creating a barrier to heat transfer and restricting air flow over the coils. The buildup of frost on the coils isolates the compressor capacity controller and thereby prevents it from sensing the actual room temperature.

Numerous methods have been used in the past to deal with this problem. One of the earliest methods for defrosting a refrigeration system was to mechanically remove the frost by hand. This method is impractical and uneconomic for large refrigeration systems, however, because it requires removal of the refrigerated items from the storage room.

Other methods for defrosting a refrigeration system include water defrosting, salt brine defrosting and glycol brine defrosting. Each of these methods employs a system for spraying a liquid solution over the heating coils to remove accumulated frost. Although these methods are relatively effective, they can cause corrosion of the evaporator coils and lead to maintenance problems. Furthermore, these methods are not economic for certain applications.

The most popular current methods for defrosting refrigeration systems operate by melting the frost on the surface of the evaporator, rather than washing or mechanically removing it therefrom. These methods typically use warm air, resistance heat or warm gas (usually waste heat from the system). The hot gas defrost system is particularly effective for large liquid expansion industrial refrigeration systems. However, the specific manner in which this defrosting method is typically used tends to result in inefficiency and unnecessary damage to the system.

In order to activate one of the above-mentioned defrost cycles, most current systems use a defrost timer clock sequencer designed only for very simple applications. This sequencer is a simple actuating system which initiates the defrost cycle at a predetermined time each day regardless of the temperature and humidity conditions present inside and outside of the refrigeration system. The use of such a simple defrost cycle, regardless of the system parameters, causes an increased load on the compressor and wastes energy. Furthermore, under certain conditions, such a timed defrost cycle will cause over-defrosting, while under other conditions it may provide inadequate defrosting. Either of these conditions causes undue wear on the system and leads to uneconomic operation.

SUMMARY OF THE INVENTION

The invention method and apparatus overcomes the shortcomings of the previous refrigeration control systems by providing a control system which govern the operation of a refrigeration system based on a number of actual parameters affecting the performance of the system. The invention system comprises a programmable controller which controls the cycling of the various fluid streams in the system in response to the output of sensors placed in various appropriate locations in the evaporator unit and the cold storage compartment.

When the refrigeration system is operating in the cooling mode, the control system coordinates the timing cycles of the fan and the liquid refrigerant to ensure maximum operating efficiency. Specifically, the invention system maintains operation of the fan for a predetermined length of time after the liquid refrigerant flow cycle has been terminated. This allows the system to make maximum use of the cooling capacity of the liquid refrigerant while expending the least amount of energy.

The invention control system initiates the defrost cycle only when the measured system parameters indicate that the system is operating inefficiently and is in need of defrosting. Specifically, pressure and temperature sensors in the evaporator unit are used in a manner described in greater detail hereinbelow to initiate the defrost cycle as needed by the system. The sequence in which the defrost cycle is implemented in the invention system minimizes the load on the system components.

The efficiency of the invention defrosting method is enhanced by first removing any liquid from the coil before introducing hot gas therein. This is accomplished by running the fan for a predetermined time to evaporate the liquid before introducing hot gas. The supply of hot gas into the coil is terminated at an optimum time to avoid overheating the coil and thus adding to the load on the system. Pressure in the system is equalized by condensing the hot gas before returning to the cooling mode. This cycling sequence provides a gentle temperature transition which prolongs the life of the evaporator components.

DETAILED DESCRIPTION OF THE PREFERRED EMBODIMENT

Figure 1:
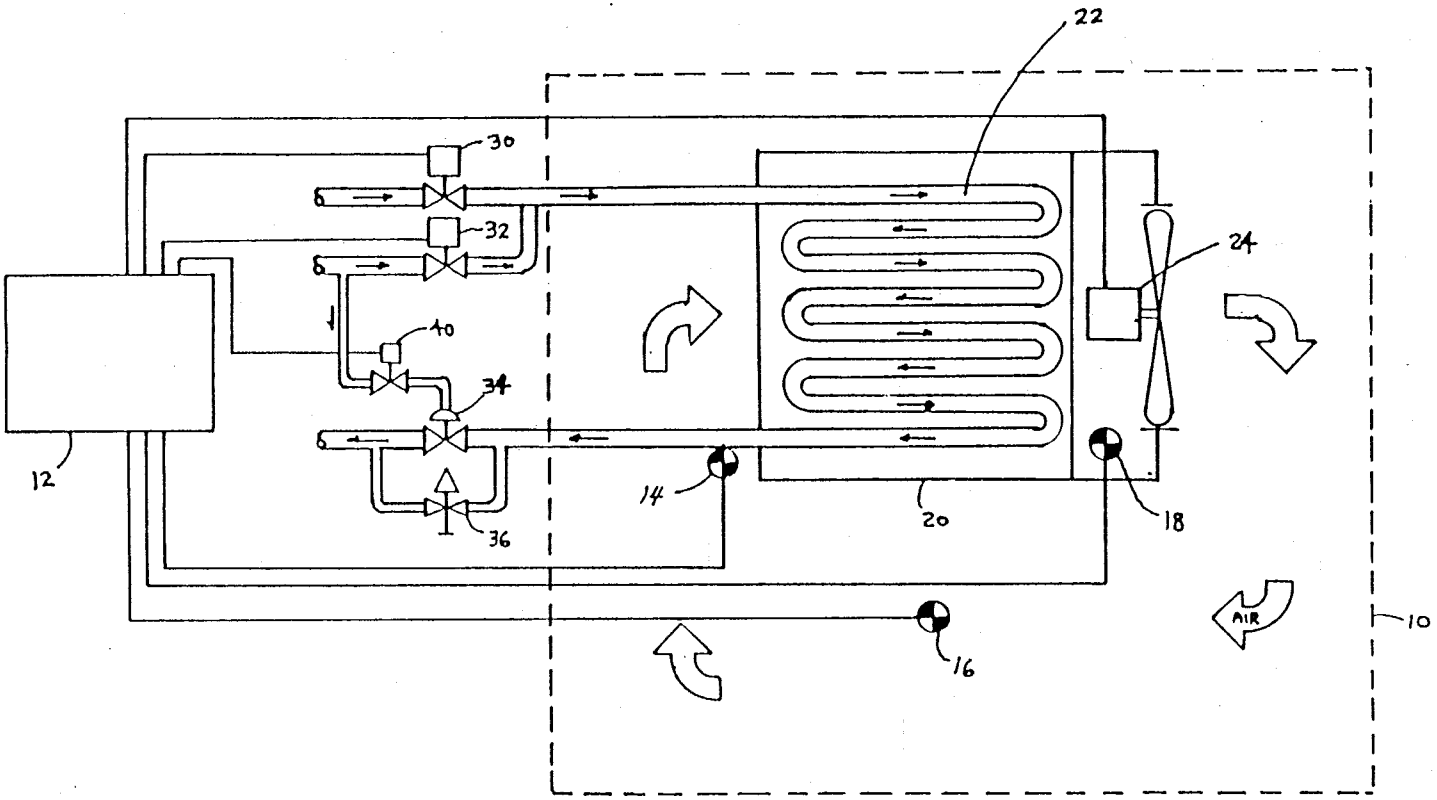
FIG. 1 is a schematic flow diagram of a typical refrigeration system having the invention control system connected thereto.

Referring to FIG. 1, a typical top feed refrigeration system 10 is shown with the control system 12 of the present invention connected thereto. The control system 12 is responsive to the respect outputs of the coil temperature sensor 14, the room temperature sensor 16 and the air pressure sensor 18. The operation of the control system 12 in conjunction with each of these sensors will be described in greater detail hereinbelow.

The refrigeration system is broadly comprised of an evaporator unit 20 along with an appropriate supply of liquid refrigerant and a hot gas. Neither of these supplies is shown explicitly in the drawings; however, they are shown as inputs to the various control valves shown in FIG. 1. The evaporator unit 20 includes an evaporator coil 22 and a motorized fan 24 for transporting air across the evaporator coil 22 to effect the desired heat exchange. The arrows inside the evaporator coil 22 indicate the normal flow direction of either the liquid refrigerant during the cooling cycle or of the hot gas during the defrost cycle. Although the discussion throughout this specification shall make reference to top feed refrigeration systems, it is to be understood that the invention control system has the same beneficial results when used in conjunction with other refrigeration system designs.

The supply of liquid refrigerant to the evaporator coil 22 for use in the cooling mode is controlled by liquid refrigerant solenoid control valve 30. Similarly, the flow of hot gas for use by the system during the defrost mode is controlled by the hot gas control valve 32. With the system operating in the cooling mode, the liquid refrigerant control valve 30 is open and liquid refrigerant is circulated through the evaporator coil 22 in response to suction provided by an appropriate compressor (not shown). Air is recirculated across the evaporator coil 22 by the fan 24. The proper pressure lvel in the evaporator coil 22 is maintained by the pressure sensor of the compressor controller through the suction control valve 34.

The desired temperature in the cold storage room is maintained by cycling the liquid refrigerant control valve 30 to provide additional refrigerant to the evaporator coil 22 as needed. The cycle of the liquid refrigerant control valve 30 is controlled by the inevention control system which is responsive to the output of the room zone thermostat 16, shown in FIG. 1. The control system will turn off the fan motor 24 after the liquid control valve 30 is closed for a time period sufficient to allow the liquid refrigerant trapped in the coil 22 to evaporate completely. The cycling of the fan 24 in this manner results in decreased energy consumption and lower wear on the fan. The liquid control valve 30 and the fan motor 24 wii both return into operation when the thermostat 16 signals a demand for further cooling.

Figure 2:
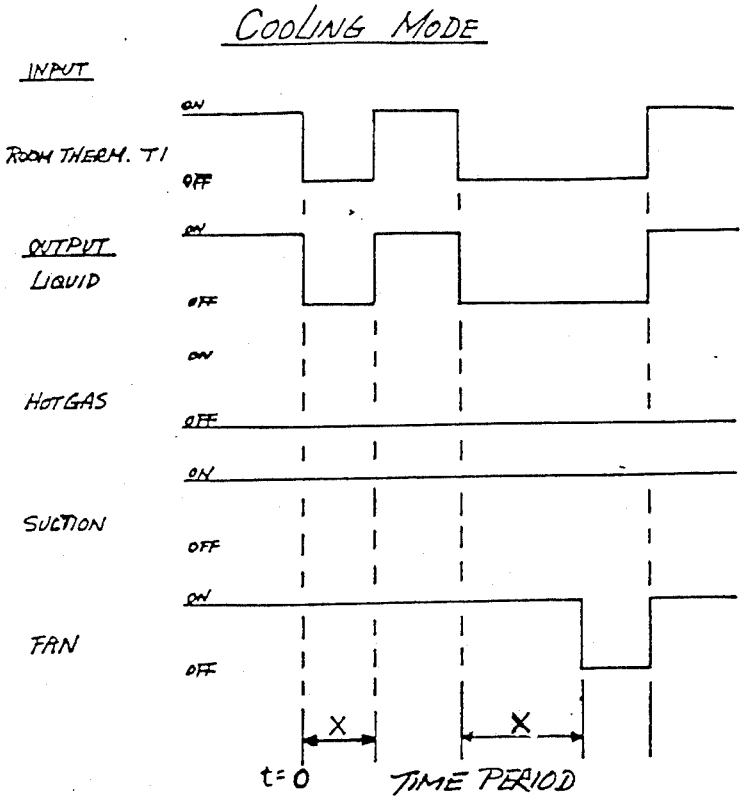
FIG. 2 is a chart showing the relative cycle times for the suction system, fan, liquid flow and hot gas flow of the system shown in FIG. 1 when operating in the cooling mode.

The cooling timing sequence can be seen by referring to FIG. 2. As can be seen, the system parameters in the cooling mode are controlled by the thermostat 16 which provides the input signal to the control system 12. The supply of liquid refrigerant to the system is cycled ON and OFF in direct response to the switching of the thermostat 16. The suction is in the ON condition during the entire cooling cycle and the hot gas is OFF during the entire cycle. As can be seen in FIG. 2, the fan remains ON for a delay period X after the flow of liquid refrigerant into the system has been terminated. In the example timing cycle shown in FIG. 2, the fan operates continuously during the first period that the flow of liquid refrigerant is terminated. However, during the second period that the refrigerant is cycled OFF, the fan continues to run for a time delay X and then cycles OFF. This delay period adds efficiency and economy to refrigeration system because the system is able to take advantage of the cooling capacity of the refrigerant which is already in the cooling coil 22. The time delay X ensures that the fan 24 will continue to operate until the liquid refrigerant trapped in the coil 22 has been totally expended. In the preferred embodiment, the time delay X is between 10 and 14 minutes, although this time period can be varied to accommodate specific system requirements.

During the cooling cycle, the evaporator coil 22 removes heat and moisture from the air stream passed over the coil by the fan 24. The moisture is deposited on the surface of the coil 22 as frost. As was discussed above, frost on the coil 22 insulates the coil and impedes heat transfer. Furthermore, the buildup of frost impedes air flow across the coil and leads to inefficiency in the system. The defrost cycle is initiated to remove the frost from the coil and thus restore efficiency to the system. Defrosting is initiated by pressure switch 18 which senses a drop in the pressure across the coil when compared to a reference fan pressure performance curve.

When the defrost cycle is initiated, the liquid refrigerant control valve 30 is closed and the hot gas supply valve 32 is opened to allow hot gas to enter the evaporator coil 22 to melt the accumulated frost. In the defrost mode, the suction valve operates as a pressurizer. The hot gas is normally provided at a pressure of approximately 175 pounds per square inch for defrosting applications. The proper pressure is maintained in the evaporator coil by the suction control valve 34 and the suction bypass valve 36. For most applications, the suction pressure is maintained at approximately 9 pounds per square inch.

During the defrost cycle, the liquid control valve 30 is closed for a period of time sufficient to allow the refrigerant trapped in the coil 22 to be evaporated by the fan 24 in the manner described hereinabove. This period of time avoids hot gas mixing with cold liquid which can result in thermal shock which damages the system and wastes energy by needlessly heating the liquid. The fan motor 24 is turned off after the trapped liquid has been evaporated, and the hot gas solenoids 32 and 40 are then turned on the suction valve 34 is turned off. The hot gas enteres the coil 22 and gradually builds up pressure and heats up the coil to melt the frost.

When the pressure and temperature in the coil 22 reach predetermined levels, the pressure relief valve 36 relieves the condensed liquid in the coil and the hot gas sensor 14 terminates the hot gas supply by turning off the hot gas supply valve 32. The pressurized coil 32 is then allowed to chill down until it is in equilibrium with room temperature. This process, in turn, serves to condense the gas to liquid and to thereby reduce the internal pressure of the gas in the coil 22. In addition, this process allows the excess water to drain out of the evaporator coil 22. One of the advantages of the above-described procedure is that it avoids the shock created by the sudden change of pressure from hot gas to suction pressure when the suction valve 34 is opened. This serves, therefore, to reduce damage to the system.

Figure 3:
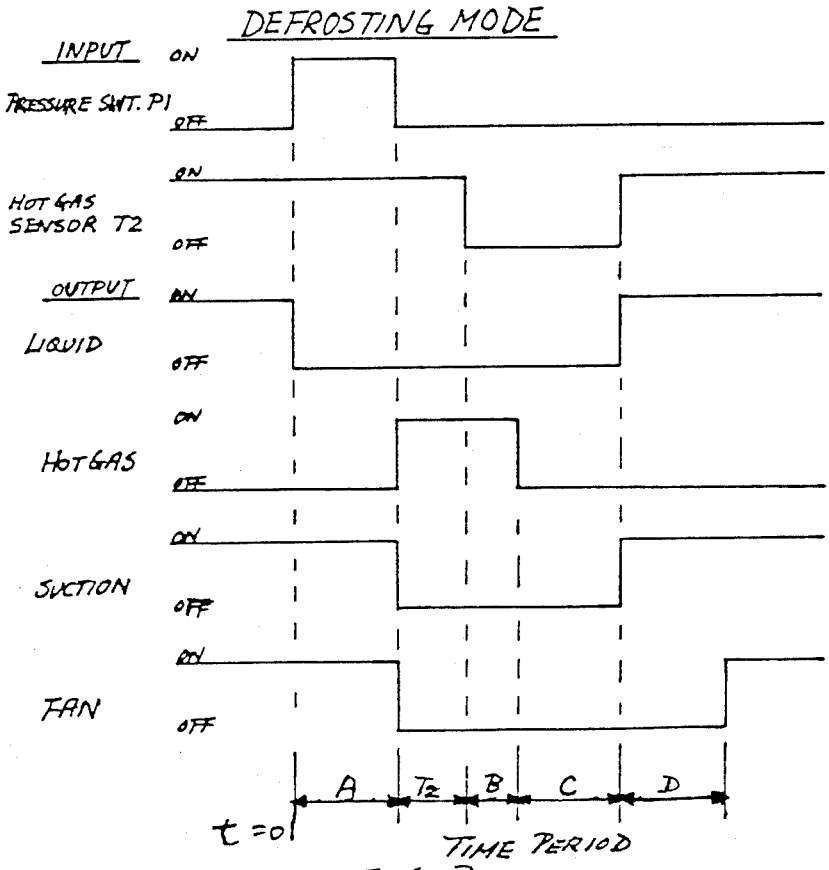
FIG. 3 is a chart showing the relative cycle times for the suction system, fan, liquid flow and hot gas flow of the system shown in FIG. 1 when operating in the defrost mode.

The steps in the defrosting sequence can be seen by referring to the timing cycle diagram shown in FIG. 3.

The inputs to the control system are provided by the pressure sensor 18 and the hot gas sensor 14. As was discussed above, the pressure sensor compares the air flow pressure across the coil to a reference fan pressure performance curve. The hot gas sensor measures the temperature in the coil 22 and senses when the coil reaches a predetermined temperature, e.g. 45° F. By sensing when the coil has reached the desired level, the control system avoids overheating the coil and needlessly wasting energy. As was mentioned above, the defrost cycle is initiated when the pressure sensor 18 detects that the air pressure across the coil 22 has dropped to a predetermined level. When the defrost cycle is initiated at time 0, the flow of liquid refrigerant into the coil 22 is terminated immediately. However, the fan and suction remain active during time period A, shown in FIG. 3, in order to remove the excess liquid from the coil. In the control system of the preferred embodiment, the time period A is approximately 10 to 14 minutes.

When the hot gas sensor 14 detects that the coil 22 has reached the predetermined temperature, it provides an OFF signal to the control system 12. The time period for the coil to reach the desired temperature is represented by time T2 in FIG. 3. While this time will vary according to the specific system, a typical time for an industrial system to reach the desired temperature of 45° F. would be approximately 12 to 15 minutes. After time period T2, the hot gas continues to flow into the coil 22 for a timer period B which is approximately 2 minutes. During this time period, excess water is drained from the coil 22.

During time period C, approximately 10 minutes, all inputs to the system are in the OFF condition. During this time period, the pressure in the coil 22 is allowed to equalize to avoid shock to the system when the cooling cycle is initiated. At the end of time period C, a small amount of moisture remains on the coil 22. This moisture is quickly frozen during time period D by initiating suction and allowing liquid to flow into the coil 22. For a typical system, time period D will be approximately 10 minutes. At the end of time period D, the defrost cycle is complete and the system is returned to the cooling mode.

In the preferred embodiment, the desired timing sequences for both the cooling mode and the defrost mode are accomplished through the use of a programmable timer. It will be apparent to those skilled in the art, however, that a conventional microprocessor can be adapted to perform the desired timing and switching functions of the invention control system.

The invention control system offers numerous advantages over previous refrigeration control systems. The fan delay cycle during the cooling cycle ensures that the refrigeration system provides the maximum cooling possible with the least amount of energy expended. The defrost cycle is not initated on a simple timing cycle, but, rather is initated only when the actual system parameters indicate that the system is in need of defrosting. Moreover, the defrost cycle of the preferred embodiment ensures that the amount of energy expended by the system is minimized and that unnecessary wear is avoided.

While the invention method and apparatus for controlling refrigerations systems has been described in connection with the preferred embodiment, it is not intended to limit the invention to the specific form set forth herein, but on the contrary, it is intended to cover such alternatives, modifications and equivalents as may included within the scope of the invention as defined by the appended claims.

I claim:

1. A refrigeration system comprising:

evaporator means including an evaporator coil having first and second ends and having an internal channel for transporting a fluid through said coil from said first end to said second end;

first valve means for controlling the flow of fluid into said evaporator coil at said first end thereof; second valve means for controlling the flow of fluid out of said evaporator coil at said second end thereof;

fan means for circulating air through said evaporator means in heat exchange relation therewith;

suction means connected to said second valve means, said suction means operable to remove said fluid from said evaporator coil;

means for providing a supply of liquid refrigerant to said first valve means;

means for providing a supply of hot gas to said first valve means;

first sensor means for measuring the drop in air pressure as said air is transported across said evaporator coil;

second sensor means for measuring the ambient temperature in a cold storage compartment, said second sensor providing a first output signal means when said temperature in said storage compartment is above a predetermined level and providing a second output signal to said control means when said temperature in said compartment is below said predetermined level; and control means responsive to the output of said first and second sensor means, said control means operable to control said fan and said first and second valve means; said control means comprising switching means for providing first and second timing cycles, said first timing cycle defining a cooling mode of said refrigeration system, said second timing cycle defining a defrost mode of said refrigeration system, said control means responsive to said first output signal to actuate said fan and said first valve means to provide a stream of liquid refrigerant to said coil and responsive to said second output signal to actuate said first valve means to terminate the flow of sad stream of liquid refrigerant to said coil, said control means further comprising timer means producing a control signal to terminate operation of said fan at a predetermined time interval after said flow of liquid refrigerant has been terminated.

2. A refrigeration system according to claim 1, said predetermined time interval being between 10 and 14 minutes.

3. A method for controlling a refrigeration system, said refrigeration system comprising an evaporator means including an evaporator coil for transporting a stream of liquid refrigerant and a fan for circulating a stream of air across said evaporator coil in heat exchange relation therewith, comprising the steps of:

sensing the pressure of said stream of air circulated across said evaporator means;

terminating the flow of liquid refrigerant through said coil when said pressure of said stream of air drops below a predetermined level;

circulating air across said evaporator for a first time interval sufficient to cause the liquid refrigerant in said coil of said evaporator means to evaporate;

terminating the flow of air across said evaporator coil; 'providing a stream of hot gas into said coil of said evaporator coil for a second time interval;

terminating the flow of said hot gas into said coil;

cooling said coil for a third time interval sufficient to allow the pressure in said coil to drop to a predetermined level;

providing a stream of liquid refrigerant into said coil for a fourth time interval; and circulating a stream of air across said evaporator coil in heat exchange relation therewith.

4. The method according to claim 3, said first time interval being between 10 and 14 minutes.

* * * * *